US009404718B1

(12) United States Patent
Shaver et al.

(10) Patent No.: US 9,404,718 B1
(45) Date of Patent: Aug. 2, 2016

(54) MULTI-SHOT DISRUPTER APPARATUS AND FIRING METHOD

(71) Applicant: Vadum Inc., Raleigh, NC (US)

(72) Inventors: Jesse Hart Shaver, Cary, NC (US); Aaron Lael Walker, Durham, NC (US); Michael Joseph Trapani, Raleigh, NC (US); Jennings Gary Edge, Durham, NC (US); Todd Nichols, Cary, NC (US)

(73) Assignee: Vadum Inc., Raleigh, NC (US)

( * ) Notice: Subject to any disclaimer, the term of this patent is extended or adjusted under 35 U.S.C. 154(b) by 545 days.

(21) Appl. No.: 13/694,768

(22) Filed: Jan. 3, 2013

(51) Int. Cl.

| | |
|---|---|
| ***F41B 9/00*** | (2006.01) |
| ***F41H 11/00*** | (2006.01) |
| ***F41A 21/06*** | (2006.01) |
| ***F41A 29/04*** | (2006.01) |

(52) U.S. Cl.
CPC ..... *F41H 11/00* (2013.01); *F41A 21/06* (2013.01); *F41A 29/04* (2013.01); *F41B 9/0046* (2013.01)

(58) Field of Classification Search
CPC ..... F41B 9/0046; F41B 9/0087; F41H 11/00; F41H 11/12; F41H 11/13; F41H 11/16; F41A 21/06; F41F 1/10
USPC ..... 89/1.13, 126; 102/402–403; 86/50
See application file for complete search history.

(56) References Cited

U.S. PATENT DOCUMENTS

| | | | | |
|---|---|---|---|---|
| 4,269,109 | A * | 5/1981 | Stoner | 89/198 |
| 4,478,128 | A * | 10/1984 | Black et al. | 89/7 |
| 6,408,731 | B1 * | 6/2002 | Elsener | 86/50 |
| 7,481,146 | B2 * | 1/2009 | Weiss | 89/14.3 |
| 7,878,105 | B2 * | 2/2011 | More | 89/43.01 |
| 7,947,937 | B1 * | 5/2011 | Langner | 244/3.16 |
| 7,975,596 | B2 * | 7/2011 | Darian | 89/191.01 |
| 8,544,203 | B2 * | 10/2013 | Jackson | 42/116 |
| 8,783,185 | B2 * | 7/2014 | Jacobsen et al. | 102/501 |
| 8,915,004 | B1 * | 12/2014 | Langner | 42/69.01 |
| 2004/0050240 | A1 * | 3/2004 | Greene et al. | 89/41.06 |
| 2010/0175547 | A1 * | 7/2010 | Hoffman | 89/9 |
| 2010/0275768 | A1 * | 11/2010 | Quinn | 89/41.05 |

* cited by examiner

*Primary Examiner* — Stephen M Johnson
*Assistant Examiner* — Benjamin Gomberg
(74) *Attorney, Agent, or Firm* — Emily M. Walker

(57) ABSTRACT

A method and apparatus for firing a plurality of disrupter loads in arbitrary order at the discretion of the user is disclosed. The loads may be of the same or different types. Both liquid and solid projectiles may be fired. Further, the disrupter may be operated by a user at safe standoff distance from a robotic mount with the aid of control, targeting, ranging and recoil systems.

22 Claims, 11 Drawing Sheets

MULTI-SHOT DISRUPTER APPARATUS AND FIRING METHOD

ACKNOWLEDGEMENT OF SUPPORT AND DISCLAIMER

This material is based upon work supported by the United States Army under Contract No. W15QKN-12-C-0005. Any opinions, findings and conclusions or recommendations expressed in this material are those of the author and do not necessarily reflect the views of the Army.

BACKGROUND

The present invention generally relates to the field of explosive ordinance disposal, and more particularly to an apparatus and method for disrupting explosive devices allowing multiple shots delivered in an arbitrary order at the discretion of the user.

Disrupters are typically used by law enforcement and military personnel to disable explosive devices. Disrupters often operate by driving a projectile, such as water or a solid projectile, which penetrates or otherwise disrupts an explosive device without detonating the explosive. A variety of projectile-based disrupter designs have been created to address the unique dangers of the operating environment. For example, disrupters are often designed to be operable by personnel located at a safe standoff distance from a suspected explosive device. Other designs focus on improving performance or ease of use by adding features such as recoil mitigation, disposable components, light material construction, or enhanced projectile design. However, prior art designs do not adequately provide multi-shot disruption capability to an operator, particularly when the operator is located at a safe standoff distance from the explosive device.

Law enforcement and military personnel encounter explosive devices located in vehicles or within concealing packaging. Multiple disrupter shots are often necessary to access and disable such devices, requiring bulky multiple disrupter barrels or single-shot disrupter reloading. Size and weight constraints of robotic mounts limit the usefulness of prior art designs employing multiple barrels. Prior art single-shot devices, requiring manual loading by operators between disrupter shots, cause operational delay. For robot-mounted disrupter operations, the robot must return the single-shot disrupter to personnel at the safe standoff distance for reloading between each disrupter shot, causing additional delay. Further, the operator may desire to use different cartridge load and projectile combinations for specific shots in a single operation, requiring multiple disrupters or disrupter reconfiguration. Deploying multiple disrupters in such cases can be cost-prohibitive. Disrupter reloading and reconfiguration in such cases can be time-prohibitive.

SUMMARY

The present invention provides a method and apparatus that allows firing of a plurality of disrupter loads in arbitrary order at the discretion of the user. Embodiments of the invention set forth in the accompanying drawings and description integrate design features to address multi-shot operation in common explosive device disruption operational conditions, including remote operation of the disrupter from a robotic mount. These embodiments provide mechanized multi-shot firing capability of stored ammunition cartridges in any desired sequence without loading the magazine in any particular pre-determined order—allowing the user to repeatedly engage one or more targets using customized loads without the operational delay of robot return and manual reloading. Other features and advantages of the invention will be apparent from the description, drawings and claims.

In the first exemplary embodiment of the apparatus, a multi-shot disrupter comprising a barrel, firing chamber, breech plate, magazine, feeder, firing mechanism, and control system is disclosed. The magazine stores at least two ammunition cartridges and moves to align the ammunition cartridges with the firing chamber. Additionally, the magazine design provides storage for ammunition cartridges of varying length, non-ammunition accessories such as targeting devices and rangefinders, and blank-propelled projectiles. A feeder loads aligned ammunition cartridges into the firing chamber. The independent movement of the magazine and feeder allows loading of ammunition cartridges from the magazine into the firing chamber in any arbitrary order as selected by the user. The firing mechanism initiates a selected and loaded ammunition cartridge charge. The breech plate and firing chamber direct the thrust of ammunition cartridge propellant gas during firing while the barrel guides a projectile toward a target. A control system is incorporated to facilitate mechanized control of the multi-shot disrupter. In some embodiments, the control system includes at least one feedback sensor, a user interface, a command interpreter, a command sequencer, and a command execution system. The control system facilitates remote operation of the multi-shot disrupter by the user. In some embodiments, such as those firing cased ammunition, an extractor provides mechanized removal of ammunition cartridges from the firing chamber by a remotely located user.

In an alternate embodiment of the apparatus, a plurality of firing chambers provide storage and arbitrary-order barrel bore alignment of ammunition cartridges while the independent movement of the firing mechanism initiates the ammunition cartridges in any arbitrary order as selected by the user.

In another exemplary embodiment of the apparatus, the multi-shot disrupter is adapted to load and discharge fluid projectiles. During filling operations, fluid driven by a pump flows from a fluid reservoir through a fluid-tight filling conduit and the second seal plug into the barrel bore. As fluid enters the barrel bore, a first seal plug advances along the barrel bore to create a fluid pocket within the bore for use as a projectile. This embodiment allows mechanized breech loading of fluid projectiles. Fluid projectiles are preferred in many disrupter operations.

In a further exemplary embodiment of the apparatus, a recoil system is incorporated to adapt the multi-shot disrupter for use in situations where trunnion force applied to the mount must be limited. During firing, recoil momentum is imparted to the disrupter in the opposite direction of projectile momentum. Recoil force and kinetic energy can damage the disruptor or mount if not reduced or absorbed through design considerations. The recoil system disclosed includes a motion guide and a dissipator system. The motion guide directs the recoil kinetic energy of the firing disrupter into a dissipator system, which acts to absorb the recoil kinetic energy generated during disrupter firing. Some embodiments incorporate a return-to-battery system. Following recoil absorption, the return-to-battery system prepares the dissipator system for subsequent firings. These components also reduce recoil momentum and kinetic energy through mass-efficient apportionment. By apportioning a maximized fraction of the allowed total mass of the disrupter and recoil system into the recoiling mass and minimizing the fraction of the non-recoiling fixed mass, the recoil system reduces the initial kinetic energy imparted by the firing process. The disclosed recoil system embodiment facilitates use of high-velocity slug loads and high-mass water loads in robot-mounted disruptor operations, and allows implementation of disrupter design changes without affecting the overall recoil profile so long as the original multi-shot disrupter mass is maintained.

In another exemplary embodiment of the apparatus, a sighting device is incorporated to facilitate aiming of the multi-shot disrupter. The sighting device is adapted to provide a targeting beam that is parallel to and can be coaxial with the barrel bore axis of the multi-shot disrupter. During operation, the targeting beam projected by the sighting device provides accurate alignment of the barrel bore axis with a target by casting a marking light upon the target or point of reference when desired aiming alignment is achieved. In coaxial embodiments, the sighting device can then be mechanically removed from the chamber and replaced with the appropriate projectile and ammunition cartridge, with minimal disturbance of the point of aim. A sighting device placed parallel to the bore can be used to illuminate one or more points of reference near the intended point of impact to ensure that the point of impact does not shift during mechanical loading operations. The sighting device is especially suited to remote robotic platform-mounted multi-shot disrupter operation when an operator located at a safe stand-off distance cannot safely aim the disrupter by manual disrupter positioning.

In another exemplary embodiment of the apparatus, a rangefinder is incorporated to improve aiming of projectiles following a non-linear defined trajectory, such as liquid projectiles commonly used in disruptor firing. The rangefinder measures the distance between the multi-shot disrupter and a target. The rangefinder is especially suited to improve the aiming accuracy of remote robotic platform-mounted multi-shot disrupter operation when an operator located at a safe stand-off distance cannot safely aim the disrupter by manual disrupter positioning. The rangefinder may also be used to judge the proper distance between the disrupter muzzle and target surface, in order to assure that the proper projectile energy is delivered to the target, or to protect the disrupter or robotic mount from projectile fragments or target fragments.

The method of the present invention relates to mechanized discharging of successive disrupter ammunition cartridges in an arbitrary order as selected by the user. The method of firing comprises the steps of providing a multi-shot disrupter apparatus of the present invention with a barrel, a firing chamber, a breech plate, a magazine; a feeder, a firing mechanism, and a control system; and discharging at least two ammunition cartridges in an arbitrary order selected by the user with the disrupter apparatus. The method further comprises lubricating the ammunition cartridges with molybdenum disulfide, tungsten disulfide, hexagonal boron nitride, graphite, mica, cadmium plating, wax, lanolin, oil, silicone grease, or polytetrafluoroethylene (PFTE) lubricants prior to discharge. The method also includes placement of a collar around the case head of the ammunition cartridges prior to discharge. Lubrication and collaring of ammunition cartridges facilitate post-firing extraction by limiting the adhesion of the case head of the ammunition cartridge with the firing chamber during initiation.

The method allows the operator to repeatedly engage one or more targets using appropriate loads and projectiles without manual reloading. The operator may select, chamber and fire any load or projectile type that has been stored in the magazine without pre-determination of the firing sequence, allowing subsequent load and projectile selection tailoring based upon initial firing results. The arbitrary order introduction capability precludes the need to anticipate the required order of fire at the time of magazine loading. Arbitrary introduction of multiple user-selected loads is particularly suited to improve prior art remotely controlled disrupter embodiments.

The embodiments of the present invention provide and facilitate explosive device disruption by allowing the firing multiple disrupter loads and projectiles in arbitrary order at the discretion of the user while integrating design features to address remote operation, targeting, ranging, recoil and fluid filling of the disrupter.

DETAILED DESCRIPTION

A method and apparatus for firing a plurality of disrupter loads in arbitrary order at the discretion of the user is disclosed. Embodiments of the invention set forth in the accompanying drawings and description integrate design features to address multi-shot operation in common explosive device disruption operational conditions, such as remote operation of the disrupter and robotic mount limitations.

Figure 1:
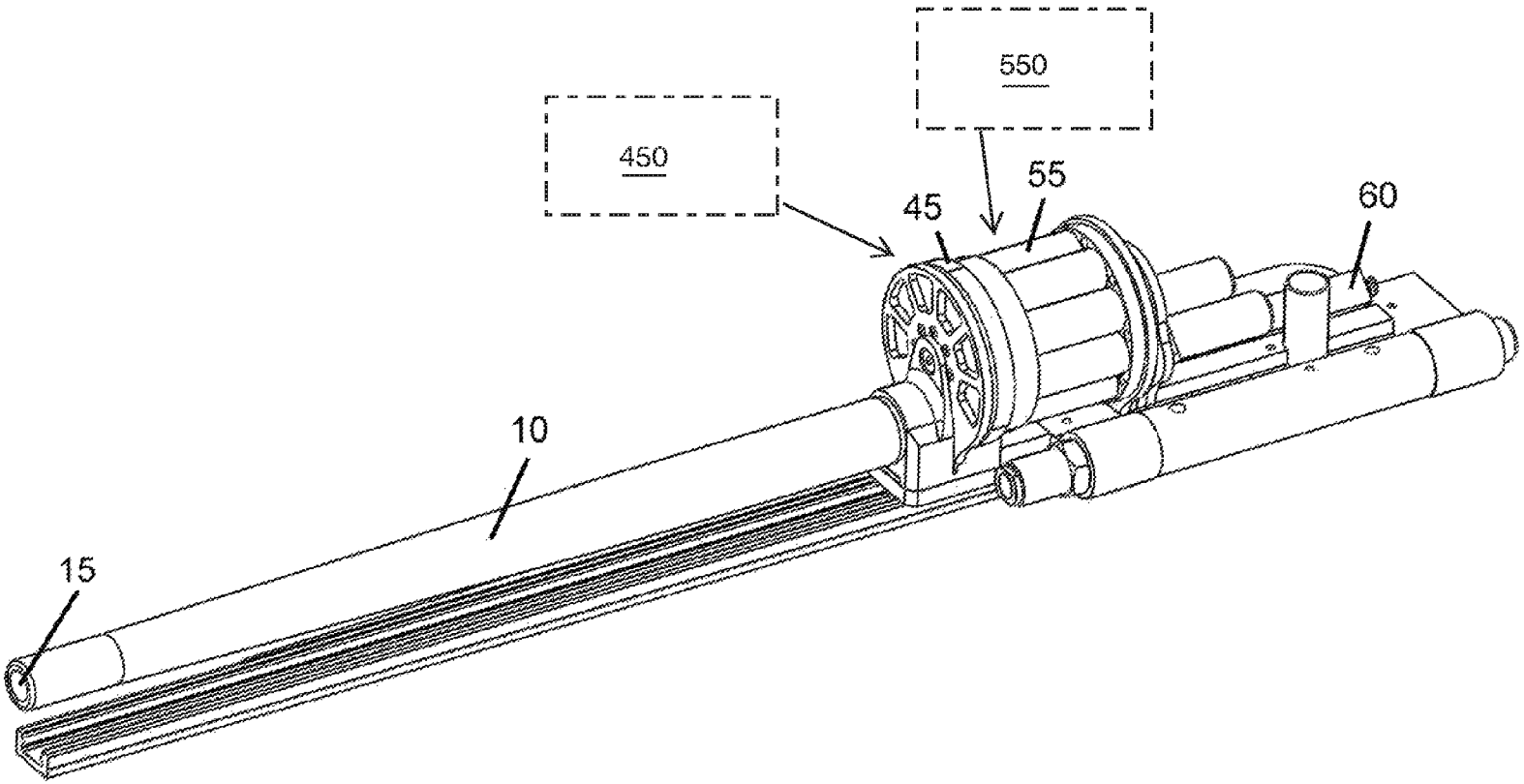
FIG. 1 is a perspective representation of the multi-shot disrupter.
Figure 2:
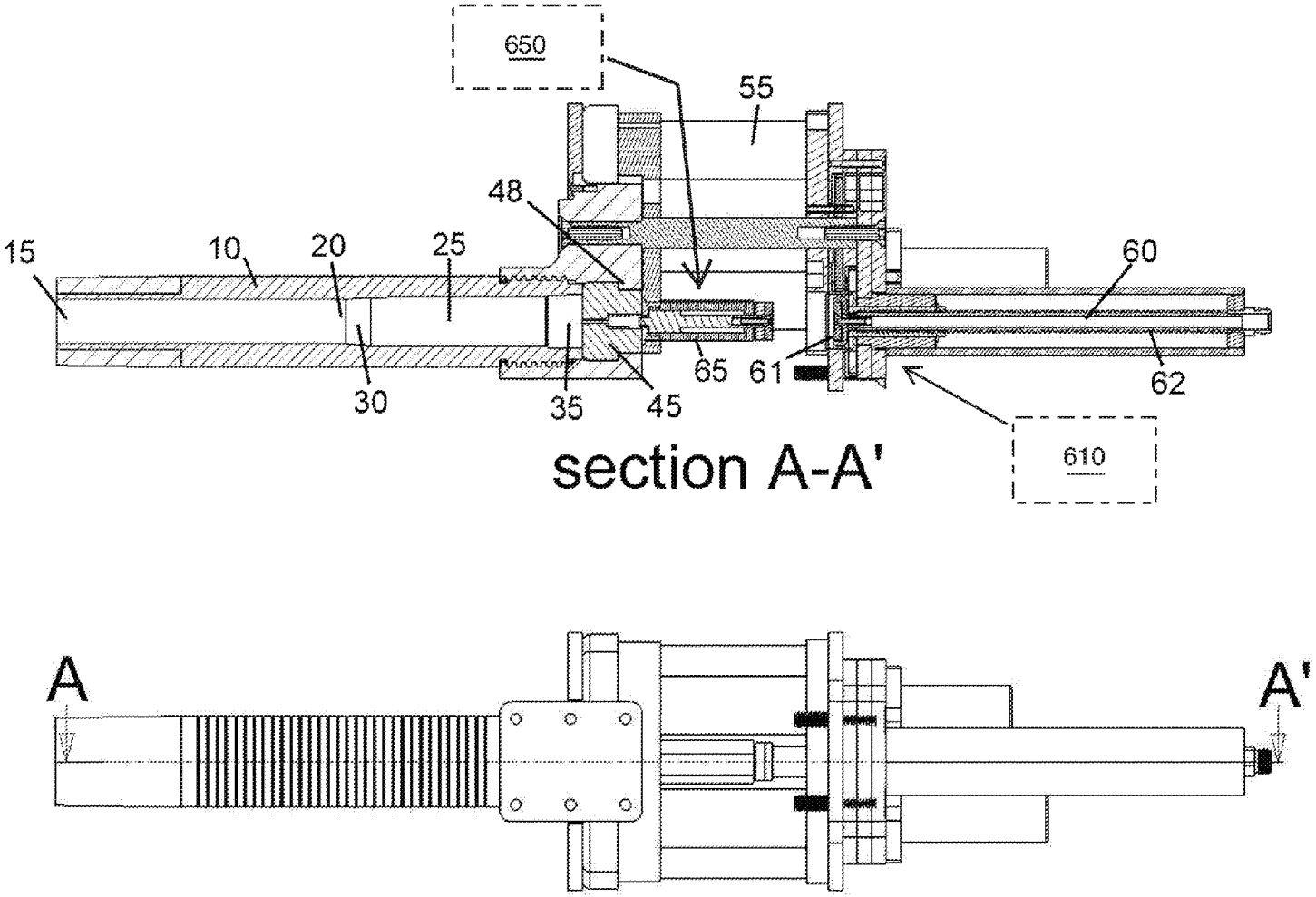
FIG. 2 is a partial sectional view of the multi-shot disrupter taken along lines A-A'.

FIG. 1 shows an embodiment of the multi-shot disrupter. FIG. 2 shows another embodiment of the multi-shot disrupter in partial section.

The barrel is a tubular pressure vessel which guides a projectile toward a target along a bore. The barrel 10 has a forward muzzle end 15 and a rearward end 20, shown in FIG. 2. The barrel is constructed of materials with adequate heat capacity, thermal conductivity, material strength, gas erosion resistance and wear resistance to withstand the high pressures characteristic of desired disrupter cartridges. A high-grade stainless steel alloy is used in some embodiments. In other embodiments where low barrel mass is preferred, an alternate material such as a titanium alloy may be used. A composite material, such as a carbon fiber material, may be used to reinforce a metallic core to construct a barrel that is strong and low-mass. Barrel wall thickness and bore design are selected based on disrupter ammunition loads and projectile types desired by the user. The bore may have a smooth cylindrical surface, or a rifled surface to impart spin to the projectile during firing. In the preferred embodiment, the barrel is removable and interchangeable to facilitate replacement and use of a wide variety of load types. The embodiment in FIG. 2 depicts a single barrel version, which is preferred to reduce system weight, but multiple barrels could be used to enable multiple shots to be fired in quick succession or to add redundancy for reliability.

The firing chamber contains the propellant gas pressure of an ammunition cartridge charge and directs this pressure to force a projectile toward the forward muzzle end of the barrel. The firing chamber wall thickness and design are selected based on disrupter ammunition loads and projectile types desired. The firing chamber is constructed of materials of adequate heat capacity, thermal conductivity, material strength, gas erosion resistance and wear resistance to withstand the chamber pressure curve of the desired ammunition load.

A single firing chamber 25 integrated with the barrel structure and coaxial with the barrel bore axis is shown in FIG. 2. However, alternate designs could include multiple firing chambers, either embodied as separate structures or integrated within a magazine. In the preferred embodiment, the chamber is integral to the barrel structure to provide a robust chamber-to-bore gas seal. A single chamber is also preferable over multi-chamber embodiments in weight-restricted operating environments such as robot mounts.

The firing chamber 25 of FIG. 2 has a forward end 30 and a rearward end 35. The bore at the rearward end 20 of the barrel abuts the firing chamber forward end 30. In the FIG. 2 embodiment, a forcing cone situated at the firing chamber forward end 30 forms a transition between the firing chamber 25 and the bore of the barrel for shotgun-type ammunition cartridge use, such as 12-gauge ammunition. However, a forcing cone may be unnecessary in embodiments using other types of disrupter ammunition, such as 0.45 Automatic Colt Pistol ammunition.

The breech plate blocks the firing chamber to resist and direct the thrust of propellant gas during firing of an ammunition cartridge. Referring to FIG. 2, the breech plate 45 moves in communication with a mount 48 to block the rearward end of the firing chamber after loading of an ammunition cartridge. The breech plate accommodates initiation of a loaded ammunition cartridge while it blocks the firing chamber. The movement about the mount 48 allows repositioning of the breech plate to open the firing chamber during ammunition cartridge loading and extraction operations.

Figure 3B:
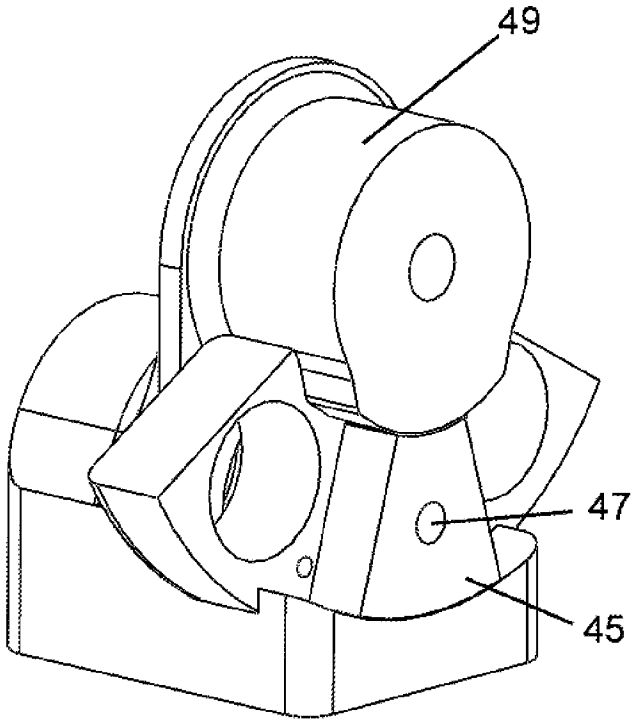
FIG. 3B is a perspective representation of the rotary breech plate in the lock position.
Figure 3A:
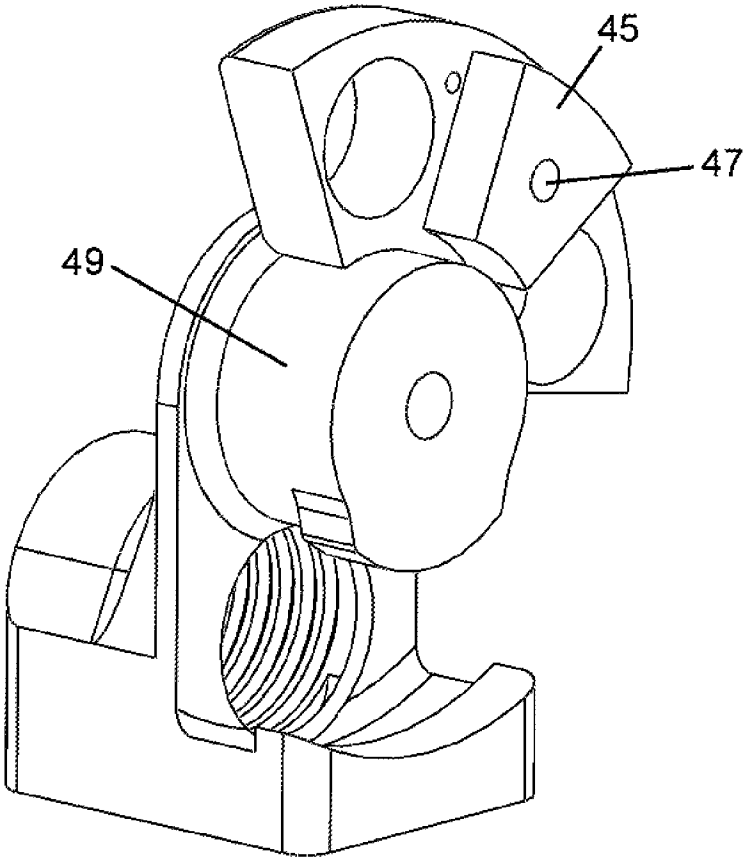
FIG. 3A is a perspective representation of the rotary breech plate in the open position.

The breech plate embodiment detailed in FIG. 3A in the open position, includes a rotary block breech plate 45 which rotates about a second axis parallel to the barrel bore axis and coaxial with the axle bearing surface 49 of the mount. The rotary block design allows the breech plate 45 to rotate to a position in line with the barrel bore axis to block the firing chamber rearward end during firing, as shown in FIG. 3B. A firing pin passage 47 in the breech plate 45 allows initiation of ammunition cartridges seated in the blocked firing chamber. The breech plate 45 rotates along the bearing surface 49 of the mount to allow ammunition cartridge loading and accessory placement in the firing chamber.

The rotary block illustrated in FIGS. 3A and 3B uses a breech plate 45 that rotates in a plane perpendicular to the axis of the barrel bore about a fixed axle frame. The axis of the fixed axle frame is parallel to the axis of the barrel bore. In the preferred embodiment, the breech plate 45 can rotate clockwise or counterclockwise through full 360-degree continuous rotation. Other locking system embodiments incorporate alternate mechanisms for positioning the breech plate with respect to the firing chamber including: a falling block, tilting block, rolling block, hinged block, threaded bolt block, interrupted threaded bolt block, a Ferguson bolt block, or rotary lugged bolt block. These alternative embodiments of the breech plate 45 are represented in FIG. 1 by the box labeled 450.

In a falling block embodiment, the breech plate translates linearly along a plane substantially perpendicular to the barrel bore axis to block and open the firing chamber.

In a tilting block embodiment, the breech plate tilts about an axis perpendicular to the barrel bore axis to block and open the firing chamber.

In a rolling block embodiment, the breech plate rotates about an axis perpendicular to and intersecting the barrel bore axis to block and open the firing chamber.

In a hinged block embodiment, the breech plate tilts through less than 360-degrees of continuous rotation about an axis parallel to the barrel bore axis to block and open the firing chamber.

In a threaded bolt block embodiment, the breech plate is attached to a helically threaded portion which screws into receiving threads oriented coaxially to the barrel bore axis to block and open the firing chamber.

In a Ferguson bolt block, a breech plate is attached to a helically threaded portion which screws into receiving threads oriented on an axis perpendicular to the barrel bore axis to block and open the firing chamber.

In an interrupted threaded block embodiment, the breech plate moves in a combination linear sliding and rotating engaging motion to block and open the firing chamber. The breech plate is attached to an interrupted thread which slides linearly into matching interrupted receiving threads on an axis coaxial to the barrel bore axis. Upon rotation, the breech plate threads engage the receiving threads to block the firing chamber.

In a rotary lugged bolt block embodiment, the breech plate moves in a sequential combination linear sliding and rotating engaging motion to block and open the firing chamber. The breech plate slides linearly on an axis coaxial with the barrel bore axis. Upon rotation, one or more locking lugs engage the receiver to block the firing chamber.

In the preferred embodiment, the magazine and feeder move independently to feed stored ammunition cartridges into the firing chamber. The magazine is capable of containing at least two ammunition cartridges. The magazine moves with respect to the firing chamber and brings the ammunition cartridges into alignment with the barrel bore axis in any arbitrary order as selected by the user. The feeder introduces aligned ammunition cartridges into the firing chamber through movement independent of the magazine, allowing arbitrary order introduction of any aligned ammunition cartridge into the firing chamber. This arbitrary order introduction capability allows the user to select subsequent ammunition cartridges in any desired sequence based on prior shot outcomes without loading the magazine in any particular order. The arbitrary introduction of multiple user-selected loads is particularly advantageous over the prior art for remotely controlled disrupter embodiments because robotic return and manual loading steps are eliminated.

Figure 4:
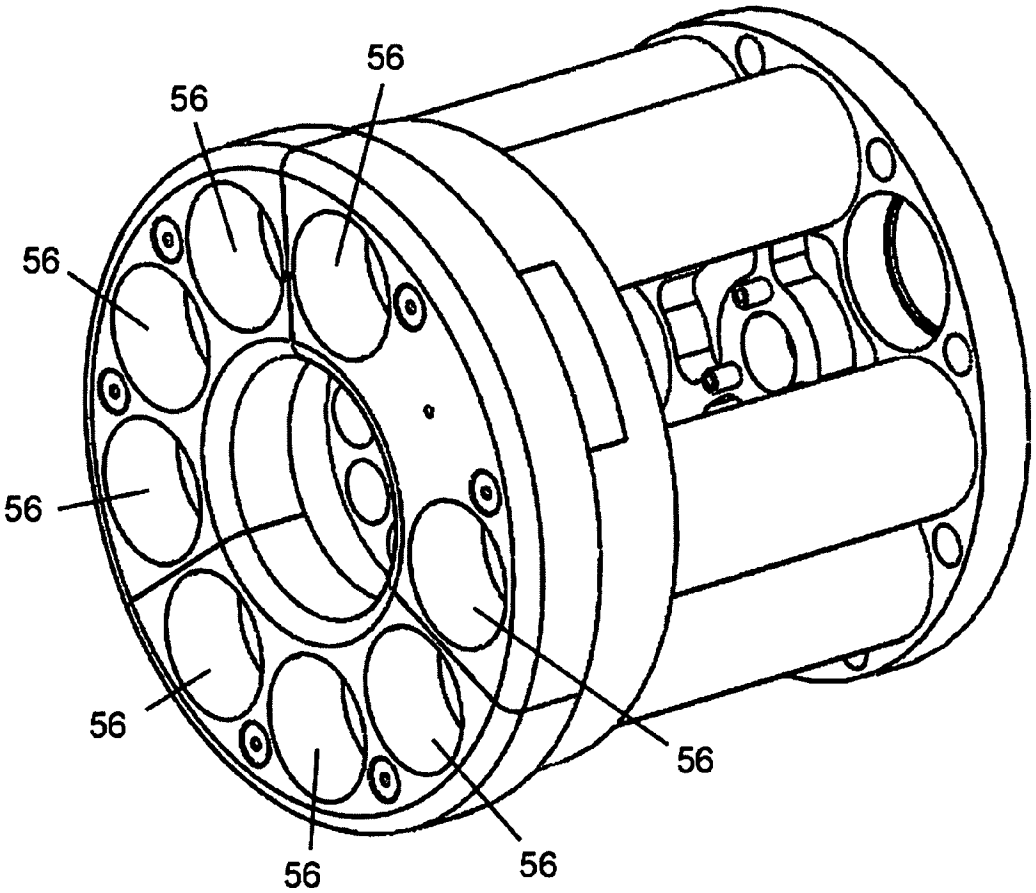
FIG. 4 is a perspective representation of the rotary magazine.

FIG. 1 includes a rotary magazine 55. The rotary magazine, detailed in FIG. 4, is adapted to store multiple ammunition cartridges in storage cavities 56. The embodiment of FIG. 4 depicts eight storage cavities 56; however, other numbers allowing for storage of at least two ammunition cartridges could be used. The storage cavities in the preferred embodiment accommodate a variety of ammunition types differing in projectile composition, propellant type, casing geometry, or casing material, for example.

The storage cavities 56 can also be adapted to store non-ammunition accessories and non-cased projectiles. Non-ammunition accessories include bore sight modules, lamps, cameras, audio sensors, chemical sensors, transponders, signal lamps, flares and strobes. Non-cased projectiles lack integrated firing primers and propellant charges. Non-cased projectiles include blank-fired projectiles, pneumatically launched projectiles, darts, spooled cables, and wires.

The rotary magazine 55 embodiment of FIG. 2 is movably mounted to rotate on a second axis parallel to the barrel bore axis. Storage cavities containing ammunition cartridges, accessories, and non-cased projectiles rotate about the second axis to align a user-selected cavity with the barrel bore axis. Although a rotary magazine is shown, a linear magazine movably mounted to align user-selected ammunition cartridges with the barrel bore axis by means of a linear translation motion substantially perpendicular to the barrel bore axis could also be used. This alternative embodiment of the magazine 55 is represented in FIG. 1 by the box labeled 550.

The feeder 60 embodiment of FIG. 2 contains a multi-function end effector 61 attached to a linear actuator 62. This feeder 60 is positioned coaxial to the barrel bore axis and introduces an aligned ammunition cartridge into the firing chamber 25 by means of a threaded drive of the linear actuator 62. The independent movement of the magazine 55 with respect to the feeder 60 allows introduction of ammunition cartridges into the firing chamber 25 in an arbitrary order selected by the user. The chambering order is not pre-determined by the order that the ammunition cartridges were placed into storage cavities of the magazine, unlike magazines which feed the chamber sequentially according to the order or reversed order of initial magazine loading. The ability to fire different cartridges in any desired order is advantageous because different cartridge types serve different functions. The most appropriate initial shot type may not be known until a remote assessment is made using robotic sensors. The most appropriate follow-on shot type may not be known in advance, until the outcome effectiveness of a previous shot can be judged by the operator.

Figure 5A:
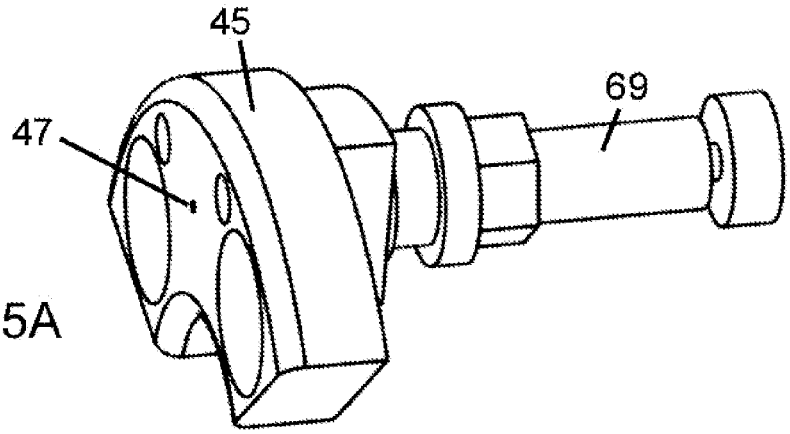
FIG. 5A is a perspective representation of the electromechanically-energized spring driven percussive striker.
Figure 5B:
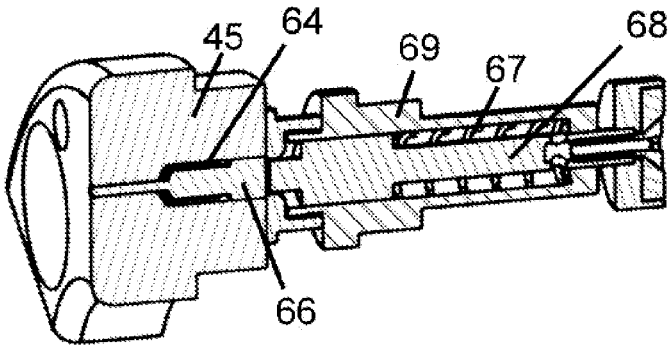
FIGS. 5B, 5C, and 5D are partial section views of the electromechanically-energized spring driven percussive striker.
Figure 5C:
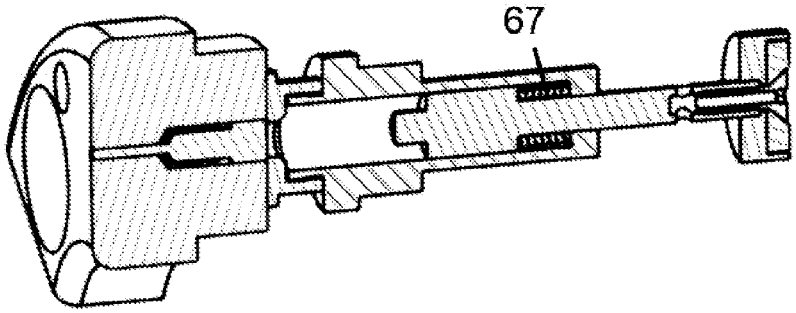
Figure 5D:
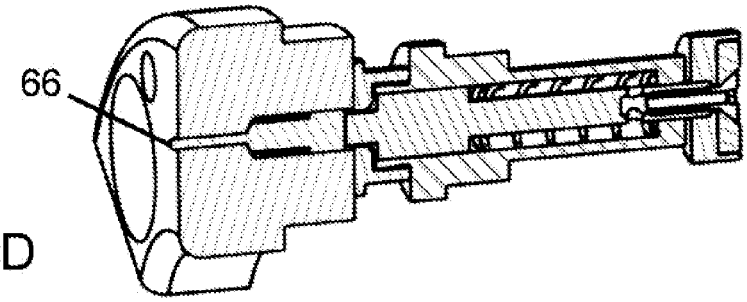

The firing mechanism initiates the propellant charge of an ammunition cartridge positioned in the firing chamber. The firing mechanism 65 embodied in FIG. 2 is an electromechanically-energized spring driven percussive striker adapted to rotate with the magazine 55 and to align in a position coaxial with the barrel bore axis during firing. FIGS. 5A, 5B, 5C and 5D detail the electromechanically-energized spring driven percussive striker embodiment. As shown in FIGS. 5B, 5C, and 5D, a mainspring 67 in communication with a striker body 68 drives a firing pin 66 with respect to a housing 69. In this embodiment, the feeder engages and withdraws the striker body 68 against the force of the mainspring 67. To fire, the striker body is released from the feeder causing the energy stored in the mainspring to plunge the firing pin through the firing pin passage 47 of the locking system 45 to initiate an ammunition cartridge seated in the firing chamber. In the preferred embodiment, the firing pin is physically distinct from the striker body and biased rearward by a spring 64. This allows the firing pin 66 to have lower mass and inertia, which reduces the chance of unintentional fire in the event of external mechanical shocks or drops.

Other firing mechanism embodiments initiate the chambered ammunition cartridge through alternate energetic means. Several alternative firing mechanism embodiments are described below and are represented in FIG. 2 by the box labeled 650. In an electrokinetic percussive striker system embodiment, energy from an electrical source, such as a battery or capacitor, is transformed directly into kinetic energy of a percussive striker without intermediate energy storage in a mainspring, for example, by means of current flow through a solenoid which drives a magnetic body in communication with the percussive striker. The percussive striker initiates an ammunition cartridge seated in the firing chamber.

In an electrothermal ignition system embodiment, an electrical current is directed from a current source, such as a battery, through an electrically resistive medium, such as a filament wire, to the ammunition cartridge in the firing chamber to initiate the cartridge charge.

In an optical ignition system embodiment, the energy from an optical source, for example a laser, is directed into the firing chamber to trigger initiation of the ammunition cartridge.

The control system provides electronic control and facilitates remote operation of the multi-shot disrupter. The control system embodiment illustrated in FIG. 6 includes multiple feedback sensors 240 and 270, a user interface 295, a command interpreter 290, a command sequencer 280, and a command execution system 200.

The user interface 295 communicates the high-level machine state of the multi-shot disrupter to the user and allows human-readable user control. Feedback sensors 240 and 270 measure the machine states 231 and 261 of controlled devices 230 and 260 of the multi-shot disrupter and provide feedback sensor outputs 241 and 271.

The user interface 295 renders machine state information originating from feedback sensor outputs. 291 into a human-readable form indicating the current machine state. The user interface 295 also provides human-readable command options associated with available machine states and allows the user to select a desired machine state from among available options. The user interface 295 outputs selected human-readable commands 296 to the command interpreter 290. In some embodiments, the user interface 295 may communicate wirelessly or through a remote wired connection with other control system components, allowing remote operation of the multi-shot disrupter by the user.

The command interpreter 290 translates selected human-readable commands 296 from the user interface into a set of machine instructions 292. The selected user-level commands are translated into the permissible machine-level instructions required to carry out the selected commands. For example, if a user selects a command "Load Cartridge A" the command interpreter 290 may perform several steps of command processing to determine the machine-level meaning of the command and the validity or permissibility of the command. Interpreted machine instructions 292 are output by the command interpreter 290 to the command sequencer 280. The command interpreter 290 also receives processed feedback sensor outputs 282 from the command sequencer 280 and interprets, translates, and outputs resulting machine state information to the user interface 295.

The command sequencer 280 is a processing block which, given the current state of the machine and the desired state of the machine, issues sequenced machine instructions 281 to the command execution system 200 according to control rules and information originating from feedback sensors 240 and 270. Feedback sensor outputs 241 and 271 are received by subsystem controllers 220 and 250. Information originating from the feedback sensors is processed by execution processor 210, and passed through signal 211, providing the command sequencer 280 with current machine-state information. The command sequencer 280 uses control rules to produce sequential machine-level commands transitioning from the current to the desired machine state. For example, if the machine state is 0001, and the final user-desired machine state is 0003, the command sequencer may issue sequential commands 0001-0002-0003 owing to a rule which precludes a direct machine transition from state 0001 to state 0003 due to a mechanical interference or other unallowable state that would occur if a direct transition from state 0001 to 0003 were attempted. Sequenced machine instructions 281 are issued from the command sequencer 280 to the command execution system 200.

Figure 6:
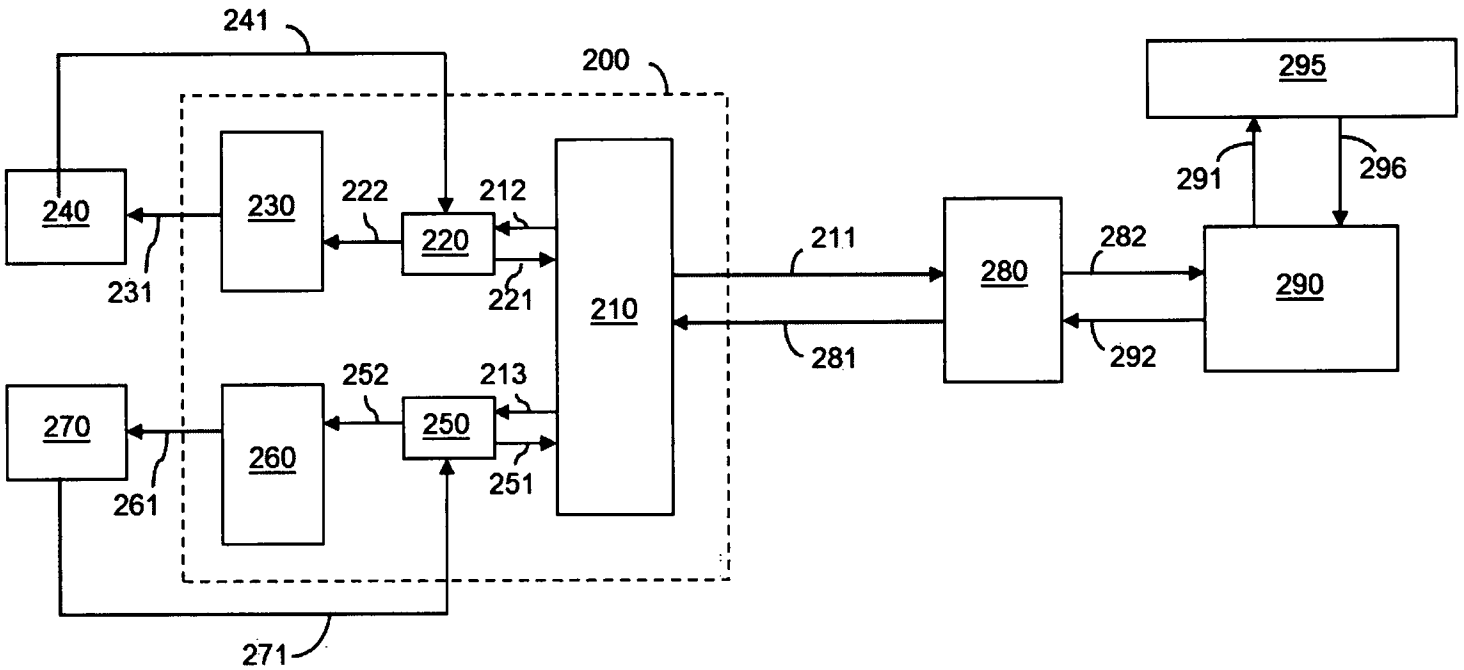
FIG. 6 is a block diagram schematic of the control system.

The command execution system 200 provides control of multi-shot disrupter devices using a command execution processor 210 and subsystem controllers 220 and 250. The command execution processor 210 receives sequenced machine instructions 281 and provides individual control signals 212 and 213 to subsystem controllers 220 and 250 to control devices 230 and 260 of multi-shot disrupter such as actuator motors, pump motors, designator lasers, range measurement systems, cameras, and other similar devices. Although only two such subsystem control diagrams are illustrated in FIG. 6, it is understood that additional subsystem control blocks are necessary to control additional subsystems. Subsystem controllers 220 and 250 are comprised of analog and digital processing elements sufficient to provide control signals 222 and 252 to directly control associated devices 230 and 260. Subsystem controllers 220 and 250 receive raw signals from feedback sensors 241 and 271 measuring the machine state of controlled devices 230 and 271 at a relatively high data rate. Subsystem controllers 220 and 250 adjust the direct control signals 222 and 252 sent to the controlled devices 230 and 250 toward a defined target value based on the feedback sensor data. Subsystem controllers 220 and 250 periodically send processed feedback sensor output 221 and 251 to the command execution processor 210. The command execution processor 210 determines if the current command is executed sufficiently to allow the next sequential command according to defined rules.

Feedback sensors 240 and 270 measure the machine state of a controlled device 230 and 260. A feedback sensor is designed to transduce a signal corresponding to a measured physical quantity into a processed feedback sensor output signal which serves as an input to a control system. For example, a Hall-effect quadrature encoder may be used to produce an electrical signal to indicate the rotational position and direction of a motor. This feedback sensor output signal, fed back to a controller, can be used to actively control the position and speed of the motor rotor. If the motor is the driver of a further mechanical system, one or more additional feedback sensors can be placed on intermediate or final stages of the mechanism, such that effects due to mechanical imprecision, mechanical flexing, or mechanical hysteresis can be accounted for to produce a sufficiently accurate and precise mechanical motion profile at the output stage. Other types of feedback sensors may be used such as optical encoders, transmission optical sensors, reflective optical sensors, inductive sensors, capacitive sensors, mechanical contact sensors, and mechanical limit switches. Feedback sensors 240 and 270, illustrated in FIG. 6, provide outputs 241 and 271 in low-level raw signal form to subsystem controllers 220 and 250. The feedback sensor outputs are further processed and used by other control system components to provide control and human-readable machine state information for the multi-shot disrupter.

Some embodiments incorporate an extractor into the multi-shot disrupter design. The extractor of the multi-shot disrupter removes ammunition cartridges and other objects from the firing chamber. The extractor embodied in FIG. 2 operates to magnetically remove fired or unfired ammunition cartridges from the firing chamber 25. In the FIG. 2 embodiment, a permanent magnet attached to the multi-function end effector 61 of the feeder 60 is the engagement mechanism. The magnet engages the ammunition cartridge through movement of the feeder 60. The ammunition cartridge is withdrawn into an open storage cavity in the rotary magazine 55 by operation of the threaded mechanism of the linear actuator 62 as directed by the control system. The ammunition cartridge is released from engagement through the motion of the rotary magazine substantially perpendicular to the barrel bore axis.

Other extractor embodiments engage the chambered ammunition cartridge through alternate means. Alternative embodiments to the permanent magnet embodiment of an engagement mechanism, including an electromagnet embodiment, a mechanical hook embodiment, a piercing barb embodiment, a drill-tap embodiment, an adhesive contact embodiment, and a compliant prehensile ring embodiment, are described below and are represented in FIG. 2 by the box labeled 610. In an electromagnet embodiment, the engagement mechanism of the extractor is a magnetic field induced by flow of electrical current which operates to magnetically remove fired or unfired ammunition cartridges from the firing chamber. An electromagnet attached to an electrical current source and in communication with the feeder engages the ammunition cartridge to withdraw the ammunition cartridge from the firing chamber.

In a mechanical hook engagement mechanism embodiment, a hook adapted to catch the rim or extraction groove of an ammunition cartridge operates in communication with the feeder to remove the ammunition cartridge from the firing chamber.

In a piercing barb engagement mechanism embodiment, a barb operates in communication with the feeder to pierce the body of the ammunition cartridge to allow the feeder to withdraw the ammunition cartridge from the firing chamber.

In a drill-tap engagement mechanism embodiment, a drilling device operates in communication with the feeder to pierce the body of the ammunition cartridge and thread a screw into the pierced hole in the cartridge head, allowing the feeder to withdraw the ammunition cartridge from the firing chamber.

In an adhesive contact engagement mechanism embodiment, an adhesive in communication with the feeder adheres to the ammunition cartridge and allows the ammunition cartridge to be withdrawn from the firing chamber.

In a compliant prehensile ring engagement mechanism embodiment, a compliant prehensile ring utilizing plastic deformation, such as annular snap fit or cantilever snap fit, is adapted to catch the rim or extraction groove of an ammunition cartridge. The compliant prehensile ring operates in communication with the feeder to engage and withdraw an ammunition cartridge from the firing chamber.

In a pressurized gas extraction mechanism embodiment, a pulse or stream of pressurized gas supplied from a pressure tank, combustion event, or other suitable source is introduced into the bore or chamber while the breech is in the unlocked condition. The pressurized gas applies rearward force to the cartridge head, freeing the ammunition cartridge from the firing chamber.

Lubricant can be applied to the surface of ammunition cartridges prior to firing. Lubrication reduces the adherence of the cartridge to the chamber surface during firing and facilitates subsequent ammunition cartridge extraction from the firing chamber.

Surface treatments can also be applied to the surface of ammunition or ammunition components prior to firing. Surface treatments include sandblasting, etching, peening, or other techniques which modify the surface texture and local hardness properties. These surface treatments modify the interaction with the ammunition cartridge and chamber surface during firing events, and also modify the performance of lubricants applied to the surface.

Figure 7A:
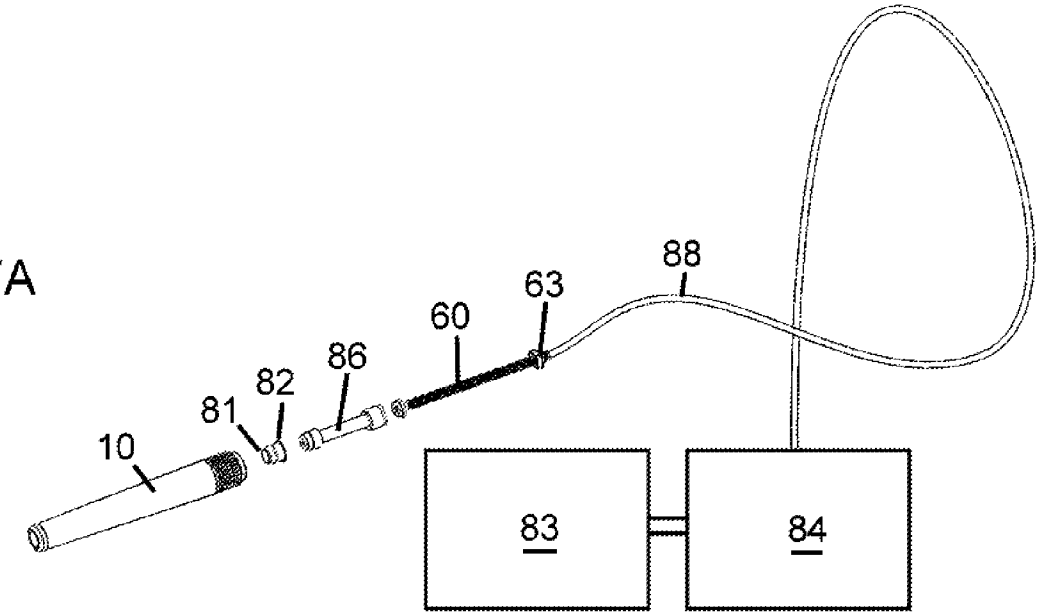
FIG. 7A is a perspective representation of the fluid filling system.

A number of embodiments incorporate a fluid filling system to adapt the multi-shot disrupter to discharge fluid projectiles. The fluid filling system embodiment detailed in FIGS. 7A and 7B includes a first seal plug 81 adapted to create a substantially fluid-tight fit while seated inside the bore of the barrel. The first seal plug 81 slides under moderate pressure along the length of the barrel bore while maintaining the fluid-tight fit against the bore wall. A second seal plug 82 creates a substantially fluid-tight closure of the rearward end of the barrel bore to prevent unpressurized fluid leakage, but is adapted to allow pressure-driven fluid flow into the barrel bore selectively through a liquid partitioning mechanism.

Many liquid partitioning mechanism embodiments can be used including: a resiliently biased slit, a nozzle plate, a valve, and a septum. In the first embodiment, a slit resiliently biased to the closed position, but which opens to allow fluid flow under pressure, is incorporated into the second seal plug. Alternatively, a nozzle plate incorporated into the second seal plug and containing a plurality of through-holes could be used. The nozzle plate holes are sized to provide fluid containment of the rearward end of the barrel bore as a result of hydraulic forces exerted through the column of fluid and the friction of the first seal plug 81 in the bore, as well as the viscosity and surface tension of the filling fluid used, but allow fluid flow under pressure. In another liquid partitioning mechanism embodiment, a one-way valve incorporated into the second seal plug, such as a flap opening toward the forward muzzle end of the barrel, allows fluid flow under pressure into the barrel bore, but closes to prevent fluid backflow. In a septum liquid partitioning mechanism embodiment, a resilient membrane in the second seal plug is pierced to allow injection of fluid under pressure into the barrel bore. The membrane resiliently closes to create a substantially fluid-tight seal following withdrawal of an injector incorporated into the fluid tight filling conduit system.

In preferred embodiments, the first seal plug 81 is adapted to removably nest with the second seal plug 82 to facilitate compact storage in the magazine and seating in the barrel bore using the feeder, and to minimize the empty volume between the first and second seal plug to minimize air bubble entrapment during fluid filling operations.

In preferred embodiments, the second seal plug 82 is adapted to lodge against the tapered surface of the forcing cone 31 at the transition from the chamber to the bore, arresting its forward motion at the point of interference. During filling operations, fluid driven by a pump 84 flows from a fluid reservoir 83 through a fluid-tight filling conduit system and the second seal plug into the barrel bore. As fluid enters the barrel bore, the first seal plug 81 advances along the barrel bore to create a fluid pocket within the bore for use as a projectile, while the second seal plug 82 remains at the forcing cone 31.

Figure 7B:
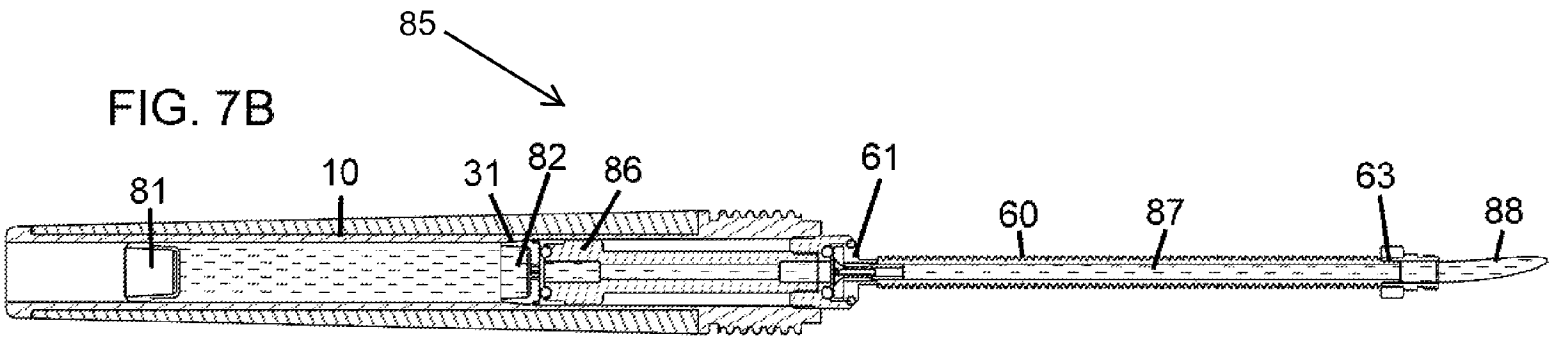
FIG. 7B is a side view representation of the fluid filling system in partial sectional view.

The fluid tight filling conduit system 85 embodied in FIG. 7B includes a filling tube accessory 86, a length of flexible hose line 88, and a fluid tight channel 87 incorporated into the feeder 60. In this embodiment, the flexible hose line 88 couples to the rearward end 63 of the feeder 60 using an Ander-Lign compression fitting; however, other fluid tight tube couplings could be used. In this embodiment, a fluid tight channel 87 runs through the feeder 60 allowing pumped fluid to pass from the flexible hose line 88 coupled to the rearward end 63 through the linear actuator and the multi-function end effector of the feeder. A filling tube accessory 86, which is hollow and removably couples to form a contact seal against the multi-function end effector 61 and the second seal plug 82, allows the pumped fluid to pass from the fluid tight channel 87 through the liquid partitioning mechanism of the second seal plug 82 into the barrel bore.

In the preferred embodiment, the filling tube accessory retracts into a storage cavity of the magazine. During fluid filling operation of a breech loading embodiment, the filling tube accessory, driven by the feeder of the loading system, seats a nested seal plug pair against the firing cone in the firing chamber and then channels fluid through the firing chamber.

The fluid filling system allows breech loading of fluid projectiles by remote operation preferred in many disrupter operations. However, other fluid filling systems could be used to load fluid projectiles into the multi-shot disrupter.

A number of embodiments address disrupter recoil through recoil absorbing systems and recoil reduction systems. A recoil absorbing system is defined as a system which converts the kinetic energy of a moving disrupter into waste heat. A recoil reduction system is defined as a system which reduces the amount of kinetic energy generated by a particular projectile launch process. During the firing process, recoil acts upon the disrupter as momentum imparted in the opposite direction of projectile travel. Recoil reduction systems reduce the initial amount of kinetic energy input into the disrupter during the firing event, while recoil absorbing systems dissipate kinetic energy of the recoiling disrupter after it has been fired.

Figure 8A:
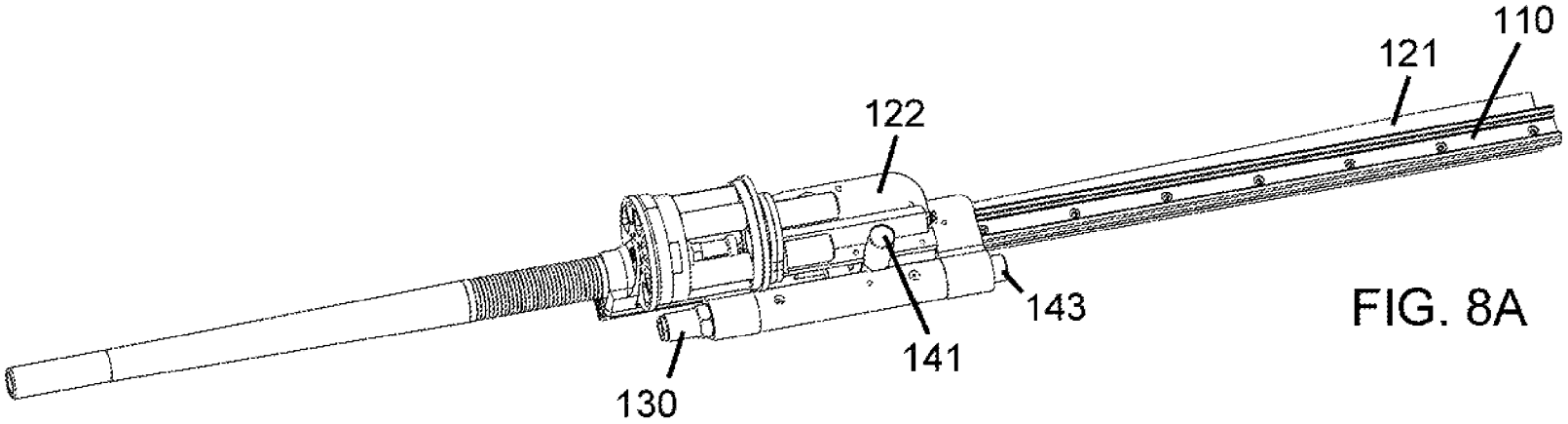
FIG. 8A is a perspective representation of the recoil system.

The recoil system embodiment of FIG. 8A incorporates recoil absorbing and recoil reduction systems. The recoil absorbing system includes a dissipator system, a return-to-battery system and a motion guide. The motion guide 110 constrains the motion of the recoiling disrupter to move in a substantially linear path. A dissipator system functions to absorb the recoil kinetic energy by converting this energy to heat. The return-to-battery system moves the disrupter into a forward firing position along the motion guide.

Figure 8B:
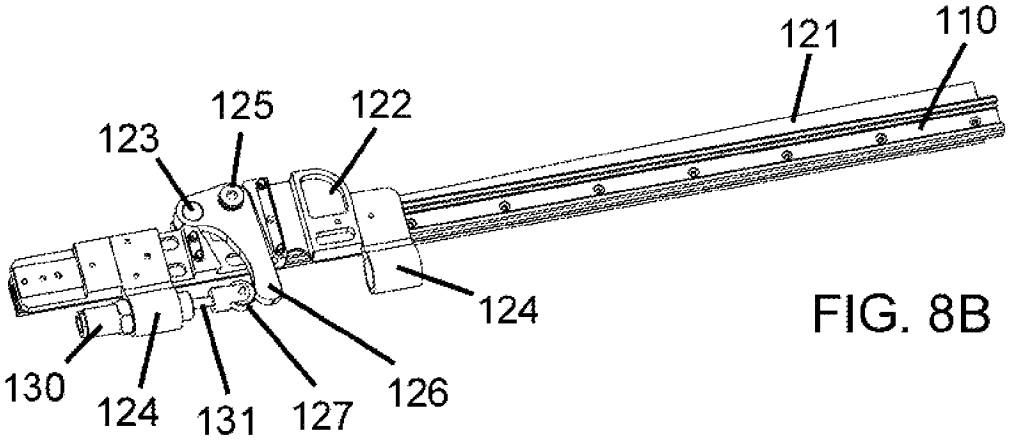
FIG. 8B is a perspective representation of the preferred embodiment of the recoil system.

In the preferred embodiment detailed in FIG. 8B, the motion guide 110 is adapted to constrain the recoiling mass of the multi-shot disrupter along a substantially linear path using a rail attached to a mobile or emplaced platform. The dissipator system is moveably mounted to translate along the rail of the motion guide 110 upon a recoil chassis 122. The recoil chassis rigidly couples to the multi-shot disrupter and transfers the recoil force from the disrupter to a hydraulic absorber assembly 130. The body of the hydraulic absorber assembly 130 attaches to the recoil chassis 122 using mount brackets 124.

The recoil system includes a transfer mechanism which transforms the motion of the recoil stroke to match the stroke of the dissipator system. As the recoiling disrupter and recoil chassis slide rearward along the motion guide 110, a roller cam follower 123 rolls along a ramp 121 rigidly coupled to the motion guide 110. The roller cam follower 123 is mounted to one end of a bell crank lever 126. The bell crank lever 126 mounts to the recoil chassis 122 upon a lever fulcrum pin 125 and converts the longer rearward recoil stroke into a shorter stroke acting upon the hydraulic absorber assembly 130. The bell crank lever 126 contacts a hydraulic piston rod 131 using a roller tip couple 127 which converts the arcing motion of the lever into linear motion acting upon the piston. The roller tip reduces transfer of side-loading forces from the lever to the rod or piston. The hydraulic piston rod 131 drives a hydraulic shock absorber to dissipate the recoil energy as heat. While the preferred embodiment for the transfer mechanism uses a roller cam follower and bell crank lever, other suitable mechanisms include crank slider mechanisms, planar linkages, Scotch yokes, and combinations of these mechanisms.

The preferred embodiment uses a variable-orifice hydraulic dissipator in the dissipator system. The variable-orifice hydraulic dissipator is designed to maintain a substantially constant reaction force throughout the recoil stroke. The length of the motion guide and size of the hydraulic shock absorber can vary to accommodate a wide range of recoil kinetic energy and transferred force according to the recoiling mass allowance and the level of force that the platform can tolerate. A variety of suitable hydraulic shock absorbers are commercially available. Other dissipator systems could alternatively be used including dry friction dissipators, pneumatic dissipators, magnetorheological dissipators, and electromagnetic dissipators.

The return-to-battery system readies the multi-shot disrupter for firing. In the embodiment of FIG. 8A, the return-to-battery system is a motorized system. An engagement motor engages a transit motor 141 attached to the recoil chassis 122 with the motion guide 110. The transit motor 141 moves the recoil chassis 122 to a pre-fire forward position along the motion guide 110. A compressor motor 143 attached to the hydraulic absorber assembly 130 compresses the hydraulic shock absorber to reduce the motor power requirements of the transit motor during a stowage operation, where it would otherwise be required to supply power sufficient to move the disrupter and compress the hydraulic shock absorber. In some embodiments, this compressor motor may be unnecessary, if adequate power is available from the transit motor or by using gravity to assist return. Other return-to-battery systems could alternatively be used including spring systems, pneumatic systems and hydraulic systems. A gravity-based configuration could also return the system to battery position and assist in stowage by orienting the motion guide upward or downward to allow gravity to act upon the recoil chassis.

The preferred recoil mitigation embodiment also implements a recoil reduction system using mass-efficient apportionment design. A disrupter system is necessarily limited in the total mass allowable, whether to remain easily portable or to remain within the limits of a robot platform or robot armature. This total allowable mass limit may be divided conceptually into a recoiling mass portion and a fixed mass portion. The mass-efficient apportionment system reduces the initial amount of kinetic energy input into the firing disrupter by apportioning a maximized fraction of the allowed total mass into the recoiling mass and a minimized fraction into the fixed portion. The recoiling mass undergoes direct acceleration during fire, while the fixed portion is not accelerated directly during fire. Due to the conservation of momentum, the product of the disrupter mass and disrupter velocity of free recoil will be equal to the projectile momentum, the product of the projectile mass and projectile velocity, including gaseous components from the propellant. The disrupter kinetic energy of free recoil will then be equal to one half times the disrupter mass times the velocity of free recoil squared. Because of the linear relationship between kinetic energy and mass, and the squared relationship between kinetic energy and velocity, it is observed that a reduction in recoil kinetic energy is achieved by increasing the recoiling mass, if the recoil momentum is held constant.

In the FIG. 8A embodiment, the motion guide 110 is attached to a platform and, therefore, represents a fixed portion of the total mass of the multi-shot disrupter system. The preferred mass-efficient apportionment embodiment minimizes the mass of the motion guide 110 by limiting the length to the anticipated recoil chassis travel required for a maximum disrupter load and by choice of strong light weight materials such as aluminum and fiber-filled composites, with limited use of heavier materials such as steel for surfaces which must be hard, such as the recoil chassis contact surfaces of the motion guide.

The dissipator system embodiment of FIG. 8B includes a ramp 121 attached to the motion guide 110 representing a fixed portion and other components mounted to the recoil chassis 122 representing the recoiling mass portion of the total mass. The preferred mass-efficient apportionment embodiment minimizes the mass of the ramp 121 by limiting the ramp length to the anticipated roller cam follower 123 travel required for a maximum disrupter load and by choice of light weight materials such as aluminum for the bulk of the ramp structure, with limited use of heavier materials such as steel for surfaces which must be hard, such as the ramp surface which contacts the roller cam follower. The mass of the ramp is also minimized by reducing the height of the ramp necessary to actuate the full stroke length of the hydraulic shock absorber. The height of the ramp is minimized by choosing a leverage ratio of the bell crank lever in order to allow a shorter ramp to actuate a longer stroke. Because the bell crank lever is accelerated along the recoil chassis, it is included as recoiling mass, which serves to reduce recoil kinetic energy.

The recoiling mass mounted to the recoil chassis 122 is maximized through system design. In the preferred embodiment, the hydraulic absorber assembly 130 is mounted to the recoil chassis 122 using the mount bracket and, therefore, is included in the recoiling mass. The multi-shot disrupter is mounted to the recoil chassis 122 so the mass of the barrel, firing chamber structure, breech plate, magazine, feeder and firing mechanism are included in the recoiling mass. The recoil chassis-mounted multi-shot disrupter embodiment allows implementation of disrupter design changes without affecting the overall recoil profile so long as the original multi-shot disrupter mass is maintained.

The return-to-battery system embodiment of FIG. 8A includes an engagement motor and a transit motor 141 directly attached to the recoil chassis 122 and a compressor motor 143 attached to the hydraulic absorber assembly 130 also mounted to the recoil chassis 122. Therefore, the mass of the return-to-battery system is included in the recoiling mass 220.

The mass-efficient apportionment system disclosed maximizes the recoiling mass and minimizes the fixed portion of the disclosed system. Other mass-efficient apportionment systems could be used to vary the fixed portion and recoiling mass of other multi-shot disrupter designs.

It is also possible to directly reduce recoil momentum by altering the net momentum of the firing process. Systems that alter net momentum could be used with the multi-shot disrupter disclosed, including muzzle brakes and counter-shot mass systems. In a muzzle brake recoil reduction system, the net momentum is reduced by redirecting of a portion of the propellant gas to work against the direction of recoil. In a counter-shot mass recoil reduction system, the net momentum imparted to the disrupter is reduced by simultaneously firing one or more additional counter shot projectiles in a direction opposing or nearly opposing the primary projectile direction.

Some embodiments incorporate a target designation system to facilitate aiming of the multi-shot disrupter. The target designation system includes optical sight adapted to provide a visible or invisible targeting beam parallel to a barrel bore axis of the multi-shot disrupter, and a provision for directly viewing the targeting beam by eye, or indirectly viewing the targeting beam with the aid of a camera, telescope, or other imaging device. During operation, the targeting beam projected by the sight forms a light to mark a target positioned at a distance from the multi-shot disrupter. A visible or invisible laser module can be used to generate a targeting beam. Use of a visible targeting beam allows aiming of the multi-shot disrupter from a remote platform by an operator located at a safe standoff distance from a target, and also permits nearby persons to directly view the beam by eye as it is projected on the target. Use of an invisible beam requires the use of an intermediate sensor which is sensitive to the invisible wavelength, such as a CCD or CMOS video camera or a night vision device. In this case, the beam is not visible to nearby persons without the use of a camera or similar device.

Figure 9:
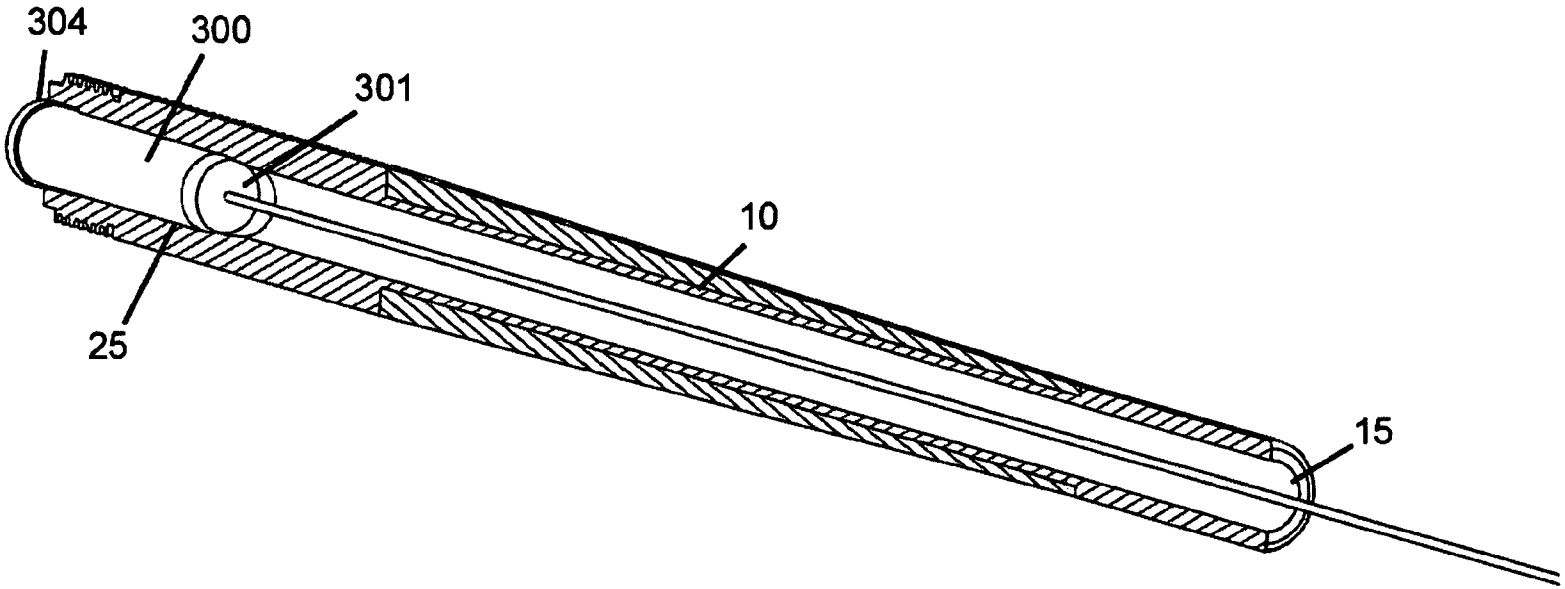
FIG. 9 is a perspective representation of the target designation system coaxial with a barrel in partial sectional view.

In the preferred embodiment of FIG. 9, the sight 300 is positioned to provide a targeting beam coaxial or nearly coaxial and parallel to a barrel bore axis. The sight 300 includes a laser beam source 301 connected to a battery power source. The sight 300 of FIG. 9 is fitted in a housing adapted to seat in the firing chamber 25 during aiming operations and seat in the multi-shot disrupter magazine for storage. During aiming operations, the laser beam source 301 is oriented toward the forward end of the firing chamber 25 and provides a targeting beam which extends through the barrel bore exiting the forward muzzle end 15 of the barrel 10.

The through-bore position of the preferred embodiment of the target designation system provides accurate alignment of the barrel bore axis with a target by casting a marking light upon the target when alignment is achieved. The marking light is visible either directly by the disrupter operator in visual line-of-sight with the target or indirectly such as by an operator viewing the target through a camera, monitoring of a control system sensor response, viewing of the target through a mirror, or by other indirect means. Optical target designation is especially suited to remote robotic platform-mounted multi-shot disrupter operation when an operator located at a safe stand-off distance cannot safely aim the disrupter by manual positioning.

In the preferred embodiment, the housing is fitted with a magnet 304 to allow retraction using the feeder into a storage cavity in the multi-shot disrupter magazine. Retraction functions can be integrated using the control system to facilitate remote aiming operations between disrupter shots.

Some embodiments incorporate a range measurement system to measure the distance between the multi-shot disrupter and a target using a rangefinder. Range measurement facilitates accurate aiming of projectiles with low ballistic coefficients which follow a parabolic or other non-linear defined trajectory, such as liquid projectiles commonly used in disruptor firing. Range measurement also facilitates effective shot planning, since the projectile energy may decrease abruptly with the distance from the forward muzzle end of the barrel. Shot effectiveness would, therefore, depend upon range in order to deliver the planned energy to the target.

Figure 10:
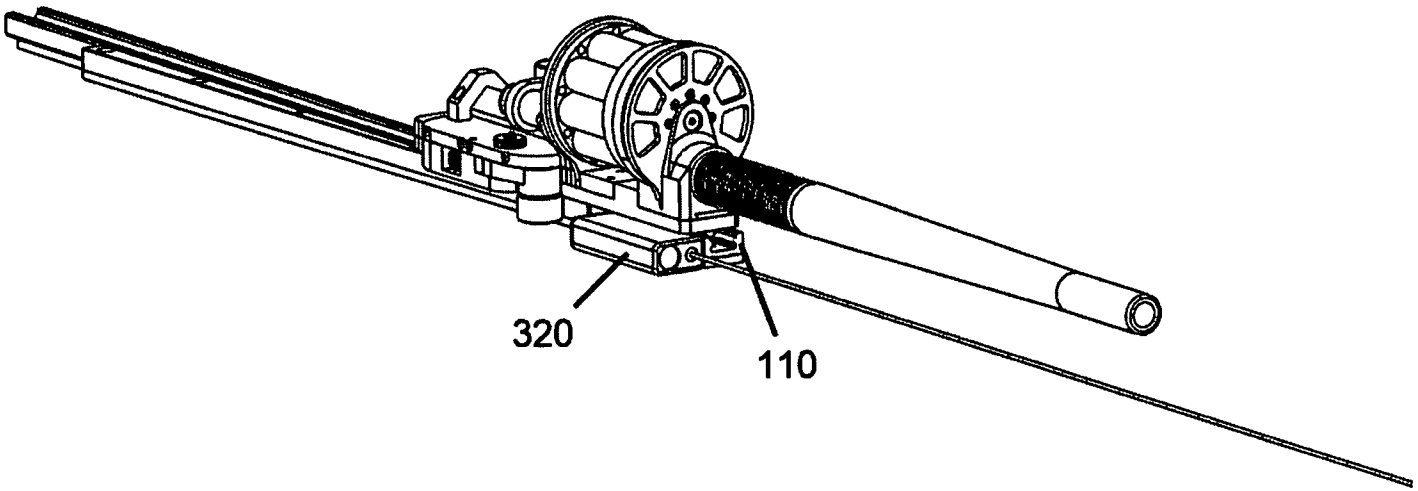
FIG. 10 is a perspective representation of a multi-shot disrupter embodiment with a range measurement system.
Figure 11:
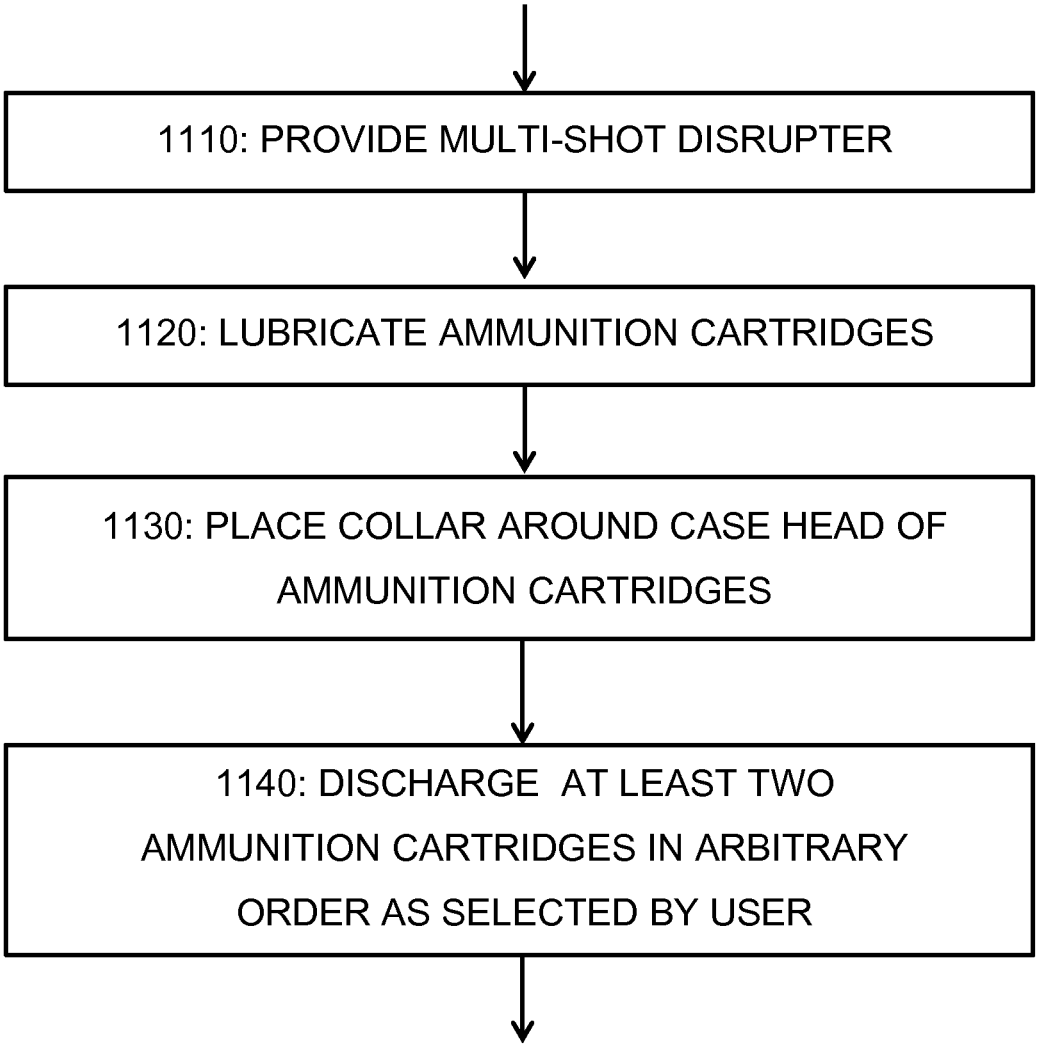
FIG. 11 illustrates an example method according to embodiments of the invention.

Although the rangefinder can be mounted directly to the disrupter or to another structure with a repeatable geometric relationship to the disrupter, consideration of rangefinder sensitivity to mechanical shock should be given when selecting the mounting position. Laser rangefinders with delicate optical components requiring precise alignment may be particularly sensitive to mechanical shock. In order to protect the rangefinder from mechanical shock of disrupter firing, the rangefinder is preferably secured to a body not subject to the full mechanical shock of firing, such as the robot arm, the motion guide, or another structure not rigidly coupled to the multi-shot disrupter or recoil chassis. The range measurement system embodiment of FIG. 10 includes a rangefinder 320 mounted to the motion guide 110 of a recoil system. Other suitable mounting positions could be selected based upon the shock tolerance of the rangefinder and the use of special shock absorbing mounting structures. In some embodiments, a programmable offset can be used to account for range variance based upon variable rangefinder mounting positions.

Several types of commercially available rangefinders can be adapted for use in the range measurement system including: ultrasonic rangefinders, optical triangulation rangefinders, optical time-of-flight rangefinders, and laser phase-shift rangefinders. These rangefinders operate over a variety of distances and accuracies accommodating various multi-shot disrupter firing scenarios.

A laser phase-shift rangefinder is preferred in embodiments requiring accurate multi-shot disrupter firing from short distances relative to the target, such as centimeter to decameter distances. The laser phase-shift range finder operates by transmitting a laser beam modulated at a plurality of relatively-prime frequencies to a target positioned at a distance from the multi-shot disrupter and measuring the phase shift of the reflection to determine distance, with ranging ambiguity resolved by the use of a plurality of frequencies. The relative accuracy and range of measurement of laser phase-shift rangefinders coincides with the useful range of standard disrupters.

An optical time-of-flight rangefinder transmits a pulsed laser beam to a target positioned at a distance from the multi-shot disrupter and measures the timing of the reflection to determine distance. Due to the speed of light and the relative timing precision of portable electronic circuitry, time-of-flight rangefinding is typically limited to resolutions of one meter or greater, which is sufficient for long range use typical of rifles and other small arms. Due to detector dynamic range considerations, a time-of-flight laser rangefinder is typically not useful for short ranges typical of disrupter use, due to detector saturation.

An optical triangulation rangefinder transmits a laser beam to a target positioned at a distance from the multi-shot disrupter and measures the angle of the reflection from a second vantage point to determine distance.

An ultrasonic rangefinder transmits a pulsed wave to a target positioned at a distance from the multi-shot disrupter and measures the timing of the reflected echo to determine distance.

In some embodiments, the range measurement system can be integrated using the control system to facilitate remote aiming operations between disrupter shots. Use of a range measurement system improves aiming accuracy of the multi-shot disrupter from a remote platform by an operator located at a safe standoff distance from a target.

The method of the present invention relates to discharging successive disrupter ammunition cartridges in an arbitrary order selected by the user. The method of firing comprises the steps of providing a multi-shot disrupter apparatus of the present invention with a barrel, a firing chamber, a breech plate, a magazine, a feeder, a firing mechanism, and a control mechanism; and discharging at least two ammunition cartridges in an arbitrary order selected by the user with the disrupter apparatus. The method further comprises lubricating the ammunition cartridges with molybdenum disulfide, tungsten disulfide, hexagonal boron nitride, graphite, mica, cadmium plating, wax, lanolin, oil, silicone grease, or polytetrafluoroethylene (PFTE) lubricants prior to discharge. Lubrication of the ammunition cartridges facilitates post-firing extraction. Waxes for lubrication include paraffin, carnuba, ceresin and beeswax, to name a few. Oils for lubrication include petroleum, animal and vegetable-based oils.

The method allows the operator to repeatedly engage one or more targets using appropriate loads and projectiles without return transport of the disrupter to the operator by robotic mount or manual reloading. The operator may select, chamber and fire any load or projectile type stored in the magazine without advanced firing sequence preparation, allowing subsequent load and projectile selection tailoring based upon initial firing results. The arbitrary order introduction capability precludes the need to anticipate the required order of fire at the time of magazine loading. Arbitrary introduction of multiple user-selected loads is particularly suited to improve prior art remotely controlled disrupter embodiments.

Having described the invention in detail with reference to the accompanying drawings in which examples of embodiments of the invention are shown, it is to be understood the forgoing embodiments are not intended to limit the form of the invention. It should also be noted that these embodiments are not mutually exclusive. Thus, components or features from one embodiment may be assumed to be present or used in another embodiment, where such inclusion is suitable.

What is claimed is:

1. A multi-shot disrupter comprising:

a barrel having a forward muzzle end, a rearward end, and a bore having a longitudinal axis;

a firing chamber having a forward end and a rearward end, wherein the forward end of the firing chamber abuts the bore at the rearward end of the barrel;

a breech plate configured to lock the firing chamber in a first position and open the firing chamber in a second position;

a magazine adapted to allow storage of at least two ammunition cartridges, wherein the magazine is moveable with respect to the firing chamber to align each of the stored ammunition cartridges with the firing chamber in any arbitrary order;

a feeder configured to translate an aligned ammunition cartridge from the magazine to the firing chamber, via the rearward end of the firing chamber, wherein the feeder is adapted to move independently with respect to the movement of the magazine and independently with respect to the breech plate;

a firing mechanism adapted to initiate an ammunition cartridge locked in the firing chamber; and a control system configured to remotely control the movement of the magazine, the feeder, and the firing mechanism.

2. The multi-shot disrupter of claim 1, wherein the breech plate is selected from a group consisting of: a rotary block, a falling block, a tilting block, a rolling block, a hinged block, a threaded bolt block, an interrupted threaded bolt block, a Ferguson bolt block and a rotary lugged bolt block.

3. The multi-shot disrupter of claim 2, wherein the breech plate is a moveable rotary block that abuts the rearward end of the firing chamber in line with the longitudinal axis of the barrel bore.

4. The multi-shot disrupter of claim 1, wherein the magazine is selected from a group consisting of a rotary magazine and a linear magazine.

5. The multi-shot disrupter of claim 1, wherein the magazine is adapted to store ammunition cartridges of different lengths.

6. The multi-shot disrupter of claim 1, wherein the magazine is adapted to store non-ammunition accessories.

7. The multi-shot disrupter of claim 1, wherein the magazine includes one or more storage cavities adapted to store non-cased projectiles, in lieu of cased projectiles.

8. The multi-shot disrupter of claim 1, further comprising an extractor having an engagement mechanism attached to a moveable mount, wherein the engagement mechanism is configured to engage an ammunition cartridge seated in the firing chamber, and wherein the moveable mount longitudinally translates an engaged ammunition cartridge through the rearward end of the firing chamber, and wherein the control system is configured to remotely control the movement of the extractor.

9. The multi-shot disrupter of claim 8, wherein the engagement mechanism of the extractor is selected from a group consisting of: a magnet, an electromagnet, a mechanical hook, a piercing barb, a drill-tap, an adhesive contact, and a compliant prehensile ring.

10. The multi-shot disrupter of claim 9, wherein the moveable mount of the engagement mechanism is the feeder.

11. The multi-shot disrupter of claim 1, wherein the firing mechanism is selected from a group consisting of: an electromechanically-energized spring-driven percussive striker, an electrokinetic percussive striker, an electrothermal ignition system, and an optical ignition system.

12. The multi-shot disrupter of claim 1, further comprising:

a first seal plug adapted to create a substantially fluid-tight fit inside the bore of the barrel, and adapted to slide within the bore of the barrel;

a second seal plug having a means for selectively allowing pressure-driven fluid flow into the bore of the barrel and subsequently creating a substantially fluid-tight closure of the rearward end of the barrel;

a fluid reservoir;

a fluid-tight filling conduit connecting the fluid reservoir with the second seal plug; and a pump adapted to drive fluid from the fluid reservoir through the fluid-tight filling conduit and the second seal plug.

13. The multi-shot disrupter of claim 12, wherein the first seal plug removably nests with the second seal plug.

14. The multi-shot disrupter of claim 12, wherein the means for selectively allowing pressure-driven fluid flow into the bore of the barrel and subsequently creating a substantially fluid-tight closure of the rearward end of the barrel is selected from a group consisting of: a slit resiliently biased to a closed position, a nozzle plate with a plurality of through-holes sized to provide fluid-tight closure of the rearward end of the barrel as a result of fluid surface tension, a valve, and a septum.

15. The multi-shot disrupter of claim 12, wherein the fluid-tight filling conduit is comprised of:

a filling tube accessory configured to direct fluid through the second seal plug, and configured to retract into the magazine;

a fluid-tight channel incorporated within the feeder configured to direct fluid through the magazine into the filling tube accessory; and a flexible hose line adapted to couple the fluid reservoir with the fluid-tight channel.

16. The multi-shot disrupter of claim 1, further comprising a sighting device adapted to provide a targeting beam at least substantially parallel to the longitudinal axis of the bore of the barrel.

17. The multi-shot disrupter of claim 16, wherein the sighting device is configured to provide the targeting beam through the muzzle end of the barrel and coaxial with the bore of the barrel, and wherein said sighting device is configured to be stowed in the magazine.

18. The multi-shot disrupter of claim 1, further comprising a rangefinder that is adapted to determine the distance between the multi-shot disrupter and a target.

19. The multi-shot disrupter of claim 18, wherein the rangefinder is selected from a group consisting of: a laser phase-shift rangefinder, an optical triangulation rangefinder, an optical time-of-flight rangefinder, and an ultrasonic rangefinder.

20. A method of firing a disrupter comprising, in combination:

providing a multi-shot disrupter that comprises a barrel having a forward muzzle end, a rearward end, and a bore having a longitudinal axis, a firing chamber having a forward end and a rearward end, wherein the forward end of the firing chamber abuts the bore at the rearward end of the barrel, a breech plate configured to lock the firing chamber in a first position and open the firing chamber in a second position, a magazine adapted to allow storage of at least two ammunition cartridges, wherein the magazine is moveable with respect to the firing chamber to align each of the stored ammunition cartridges with the firing chamber in any arbitrary order, a feeder configured to translate an aligned ammunition cartridge from the magazine to the firing chamber, via the rearward end of the firing chamber, wherein the feeder is adapted to move independently with respect to the movement of the magazine and independently with respect to the breech plate, a firing mechanism adapted to initiate an ammunition cartridge locked in the firing chamber, and a control system configured to remotely control the movement of the magazine, the feeder, and the firing mechanism; and discharging at least two ammunition cartridges in an arbitrary order as selected by a user of the disrupter.

21. The method of claim 20, wherein the ammunition cartridges are lubricated prior to discharge with a compound selected from a group consisting of: molybdenum disulfide, tungsten disulfide, hexagonal boron nitride, graphite, mica, cadmium plating, wax, lanolin, oil, silicone grease, and polytetrafluoroethylene lubricants.

22. The method of claim 20, wherein the method further comprises placing a collar around a case head of the ammunition cartridges, prior to discharge.

* * * * *